US006795772B2

(12) United States Patent
Lin et al.

(10) Patent No.: US 6,795,772 B2
(45) Date of Patent: Sep. 21, 2004

(54) METHOD AND SYSTEM FOR INTELLIGENT COLLISION DETECTION AND WARNING

(75) Inventors: Ching-Fang Lin, Simi Valley, CA (US); Dong An, Simi Valley, CA (US)

(73) Assignee: American GNC Corporation, Simi Valley, CA (US)

( * ) Notice: Subject to any disclaimer, the term of this patent is extended or adjusted under 35 U.S.C. 154(b) by 0 days.

(21) Appl. No.: 10/179,765

(22) Filed: Jun. 24, 2002

(65) Prior Publication Data

US 2003/0004642 A1 Jan. 2, 2003

Related U.S. Application Data

(60) Provisional application No. 60/300,752, filed on Jun. 23, 2001.

(51) Int. Cl.[7] ..... G08G 5/04

(52) U.S. Cl. ..... 701/301; 342/29

(58) Field of Search ..... 701/301, 213, 701/303, 200, 207, 214; 342/29, 32, 64, 65; 340/947, 961

(56) References Cited

U.S. PATENT DOCUMENTS 6,345,233 B1 * 2/2002 Erick ..... 701/301
6,480,789 B2 * 11/2002 Lin ..... 701/301

* cited by examiner

*Primary Examiner*—Marthe Y. Marc-Coleman
(74) *Attorney, Agent, or Firm*—Raymond Y. Chan; David and Raymond Patent Group

(57) ABSTRACT

A method and system for collision avoidance, carried by each aircraft, includes a miniature MEMS (MicroElectroMechanical Systems) IMU (Inertial Measurement Unit), a miniature GPS (Global Positioning System) receiver, a display, a data link receiver/transmitter, and a central processing system. Each aircraft carries a GPS receiver coupled with a self-contained miniature IMU for uninterrupted position determination. This position information is shared with other aircraft over an RF (Radio Frequency) data link. An intelligent display shows the relative positions of the aircraft in the immediate vicinity of the host aircraft and issues voice and flashing warnings if a collision hazard exists. This system provides situational awareness to the pilot and enhances the safety of flight.

60 Claims, 10 Drawing Sheets

METHOD AND SYSTEM FOR INTELLIGENT COLLISION DETECTION AND WARNING

CROSS REFERENCE OF RELATED APPLICATION

This is a regular application of a provisional application, application No. 60/300,752, filed on Jun. 23, 2001.

BACKGROUND OF THE PRESENT INVENTION

1. Field of the Present Invention

The present invention relates to a method and system for collision avoidance, and more particularly to a method and system for aircraft collision avoidance, which ensures the pilot be provided with situational awareness and enhances the safety of flight. The present invention is made with Government support under contract No. F04611-00-C-0044 and Contract No. F04611-01-C-0046 awarded by the US Air Force Flight Test Center, Edwards AFB, Calif. 93524. The Government has certain rights in the invention.

2. Description of Related Arts

Many aircrafts operate in the same airspace, such as the specially designated airspace, and perform formation and highly dynamic maneuvers. The pilots have routinely identified a midair collision between military aircraft in the same airspace as the most likely cause of their next mishap. Currently, collision avoidance is based on "see-and-avoid," SPORT/Joshua traffic advisories, or onboard aircraft sensors. Even using all of these aids to avoid collisions, pilots routinely experience what they perceive as close misses with other aircraft. There exists an absolute necessity for a collision avoidance system that provides collision alerts to pilot.

SUMMARY OF THE PRESENT INVENTION

The main objective of the present invention is to provide a method and system for aircraft collision avoidance which provides situational awareness to the pilot and enhances the safety of flight.

Another objective of the present invention is to provide a method and system for aircraft collision avoidance, wherein each aircraft carries a GPS (Global Positioning System) receiver coupled with a self-contained miniature IMU (Inertial Measurement Unit) for uninterrupted position information determination and such position information is shared with other aircraft over an RF (Radio Frequency) data link.

Another objective of the present invention is to provide a method and system for aircraft collision avoidance, which provides an intelligent display to show the relative positions of the aircraft in the immediate vicinity of the host aircraft and issues voice and flashing warnings if a collision hazard exists In order to accomplish the above objects, the present invention provides a collision avoidance system to be carried in a host aircraft, which comprises:

an IMU (Inertial Measurement Unit), including a miniature MEMS IMU, for providing inertial motion measurements;

a GPS (Global Positioning System) receiver, including a miniature GPS receiver, for providing GPS positioning measurements;

a data link receiver/transmitter, for exchanging position data between the host aircraft and another participating aircraft;

a central processing unit, for receiving the inertial motion measurements from the IMU, GPS positioning measurements from the GPS receiver, and other aircraft position information from the data link receiver/transmitter to produce different levels of warning information for the collision; and an interface and display unit, for presenting different levels of warning information for the collision avoidance to a pilot of the host aircraft.

DETAIL DESCRIPTION OF THE PREFERRED EMBODIMENT

A collision avoidance system onboard the aircraft is responsible for preventing any contact between the host aircraft and any other participating aircraft. The essential requirements for the design of a collision avoidance system for aircraft are summarized as follows:

1) Must operate continuously in real time.

2) Requires range, azimuth, and velocity between the host aircraft and the other participating aircraft.

3) Needs 360 degrees visualization about the host aircraft.

The collision avoidance subsystem for the aircraft will need to frequently (on the order of a few hertz) estimate its orientation, range and range rate relative to other participating aircraft using onboard sensor inputs. The onboard avionics system will need to process its own sensor data along with data from other participating aircraft. These data inputs constitute a diverse set of information that needs to be prioritized by the aircraft system in order to accomplish mission objectives and to prevent problems such as collisions with other participating aircraft. Three hundred and sixty degrees visualization is also a requirement in that the sensor suite must provide data with respect to the aircraft's total surroundings.

Figure 1:
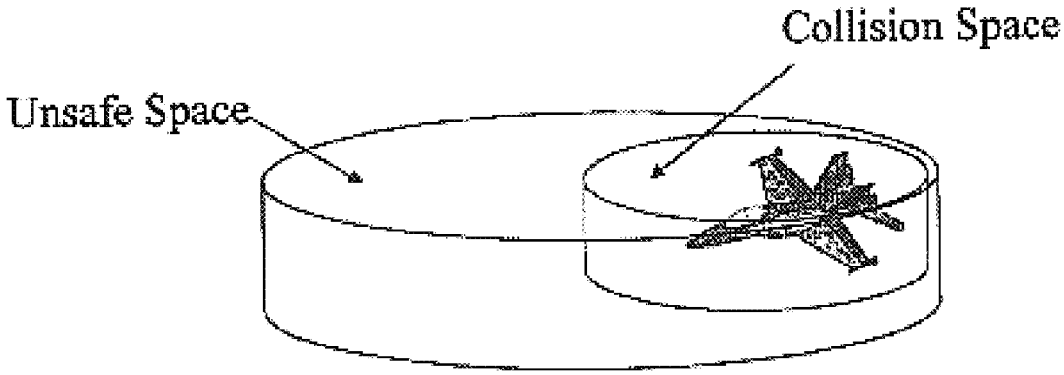
FIG. 1 is a schematic view illustrating the definition of different airspace segments for collision avoidance purposes.
Figure 2:
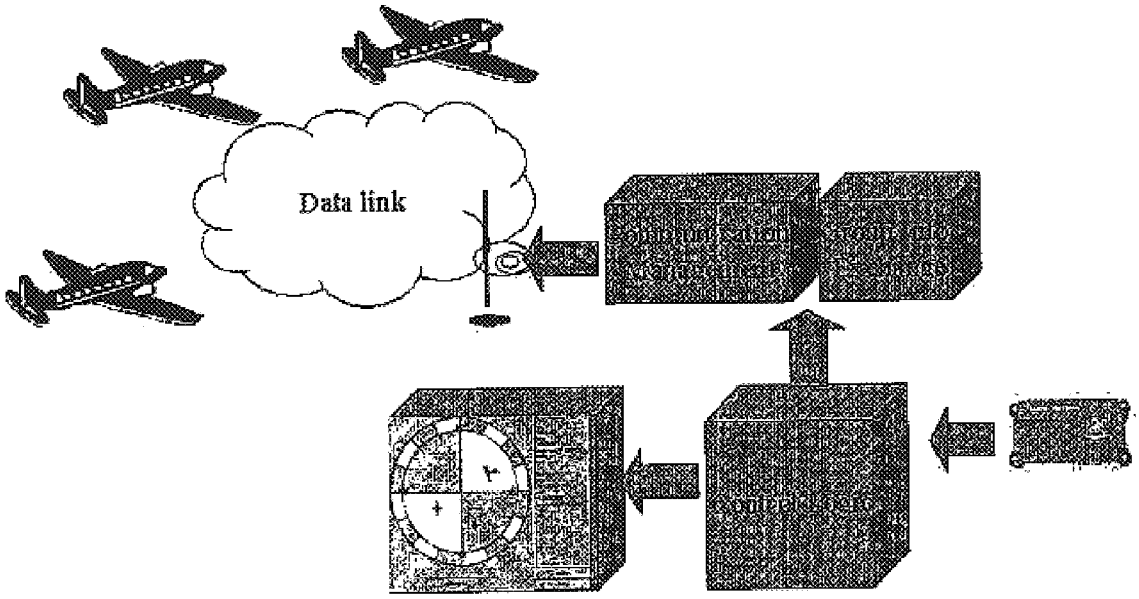
FIG. 2 is a block diagram illustrating the system structure of operation according to a preferred embodiment of the present invention.

The degree to which an aircraft must be evaded by the host aircraft, and the severity of a precarious near proximity situation, are defined by dynamic, unsafe, or risk spaces, around the host aircraft. These spaces are represented in FIG. 1. The unsafe space represents the area in which, if violated by another aircraft, the host aircraft is required to perform an evasive maneuver. These maneuvers vary from barely perceptible, to very severe, perhaps approaching the maneuverability limits of the aircraft. The collision space represents the area in which, if violated by other aircraft, not only the host aircraft will have to perform an evasive maneuver at or near the maneuverability limits, but the involved aircraft will be forced to react to the host aircraft. Otherwise, a collision is imminent.

Many different types of evasive maneuvers are available to the host aircraft to evade other participating aircraft. Horizontal maneuvers are performed by changing the heading of the host aircraft by banking or horizontal speed maneuvers or a combination of banking left or right by increasing or decreasing its speed, or vertical maneuvers by climbing or diving. Horizontal maneuvers are the most effective in providing long term separation between the two aircraft. Vertical maneuvers provide the greatest immediate separation between two aircraft. Speed maneuvers are the least effective in separating the two aircrafts and require an unacceptable length of time to effect the evasive maneuver. Any combination of the aforementioned maneuvers is possible, but generally speaking, a horizontal banking maneuver on the part of the host aircraft is the most desirable, in the event of a slight or medium range evasive maneuver. A vertical maneuver is the most advantageous, in the event of a violation of the collision space of either vehicle.

Figure 3:
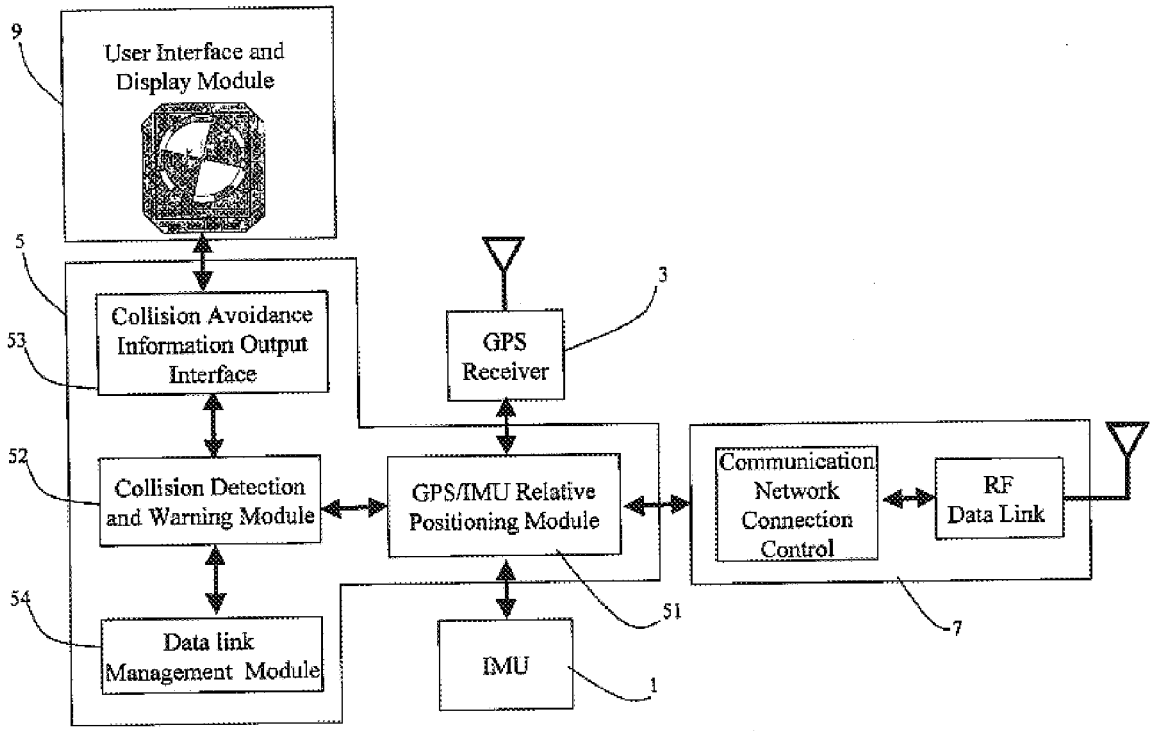
FIG. 3 is a block diagram illustrating the system configuration according to the above preferred embodiment of the present invention.

Referring to FIG. 3, the collision avoidance system of the present invention, carried in each aircraft, comprises:

(1) An IMU (Inertial Measurement Unit) 1, including a miniature MEMS IMU, for providing inertial motion measurements;

(2) a GPS (Global Positioning System) receiver 3, including a miniature GPS receiver, for providing GPS positioning measurements;

(3) a data link receiver/transmitter 7, for exchanging position data between a host aircraft and another participating aircraft;

(4) a central processing unit 5, for receiving the inertial motion measurements from the IMU 1, GPS positioning measurements from the GPS receiver 3, and other aircraft position information from the data link receiver/transmitter 7 to produce different levels of warning information for the collision;

(5) an interface and display unit 9, for presenting different levels of warning information for the collision avoidance to a pilot of the host aircraft.

Referring to FIG. 3, the central processing system 5 further comprises:

(5.1) a GPS/IMU relative positioning module 51 producing uninterrupted position information;

(5.2) a collision detection and warning module 52 receiving the uninterrupted position information from the GPS/IMU relative positioning module 51 and other aircraft position information from the data link receiver/transmitter 7 through the GPS/IMU relative positioning module 51 to produce different levels of warning information for collision avoidance;

(5.3) a collision avoidance information output interface 53 providing an interface with the user interface and the display unit 9 and feeding different levels of warning information for the collision avoidance to the user interface and the display unit 9; and (5.4) a data link management module 54 realizing and managing the communication logic for the entire system.

The present invention has the following advantages:

Innovative "COREMICRO" IMU/GPS integration for uninterrupted position information. Rapid advances in MEMS (MicroElectroMechanical Systems) technologies have made it feasible to obtain a low cost, lightweight, miniaturized, inertial navigation system integrated with the GPS chipset. Based on MEMS technologies, the assignee of the present invention, American GNC Corporation (AGNC), has successfully designed and fabricated a unique "COREMICRO" IMU, which can be used in navigation, guidance, control, tracking, pointing, and stabilization systems in areas such as ground and sea vehicles, microrovers, micro tracking mechanisms, robots, and miniature underwater vehicles. The AGNC's MEMS IMU results from newly developed MEMS gyros, MEMS accelerometers, and ASIC (Application Specific Integrated Circuit) microelectronic circuits.

Reliable wireless network for continuous data transferring among aircraft. The designed data link is a multiple access wireless network where each aircraft is a communication node. This multiple access network uses token passing methodology to guarantee Quality of Service (QoS), which gives a bounded delay and is therefore deterministic. The data link is a critical component in the situational awareness and collision warning system in terms of continuity and real time data transferring. The deterministic behavior inherent with the token passing architecture ensures QoS of the data link. Each aircraft is a token ring node, and each node reads the frame by examining each incoming bit, and then repeating it. Thus there is a 1 bit delay added to the ring propagation delay by each node in the ring. Each node is allowed to transmit frames up to a token holding time (THT). The token passing architecture supports management of the communication resources when an aircraft enters or leaves a specified air space. This feature advances the capability for encompassing an arbitrary number of aircraft, thereby providing a flexible and reconfigurable system.

Regarding to advanced situational awareness and collision avoidance mechanism, the collision avoidance system provides situational awareness and potential collision warnings to the pilot and enhances the safety of flight. The situational awareness and collision avoidance warning system also incorporates the mission data from the on-board mission computer to announce potential collision alerts. The dynamic properties of the host aircraft and current flight status including attitude and heading are employed in the situational awareness and collision avoidance mechanism to determine a flight corridor for the host aircraft. The information of the other aircraft, including position, velocity, acceleration, and heading, are utilized to detect and predict potential collisions.

The user interface and display unit 9 can be an intelligent display which is a user friendly interface providing a graphical indication of the relative locations of other participating aircrafts. The relative range is also provided to alert the pilot of potential collisions. The collision alert is designed as a combination of voice warning and emergency flashing of the approaching aircraft icon on the display. The host aircraft is located at the center of the display. Other information delivered on the display includes the relative location, range, azimuth and heading. The three safety level air spaces are identified as safety (green), unsafety (yellow), and red (emergency). For convenience, the scale of the display is dynamically changeable. The scale information for the current display is shown on the screen. Other text information about the absolute location of aircraft is also provided.

Figure 4:
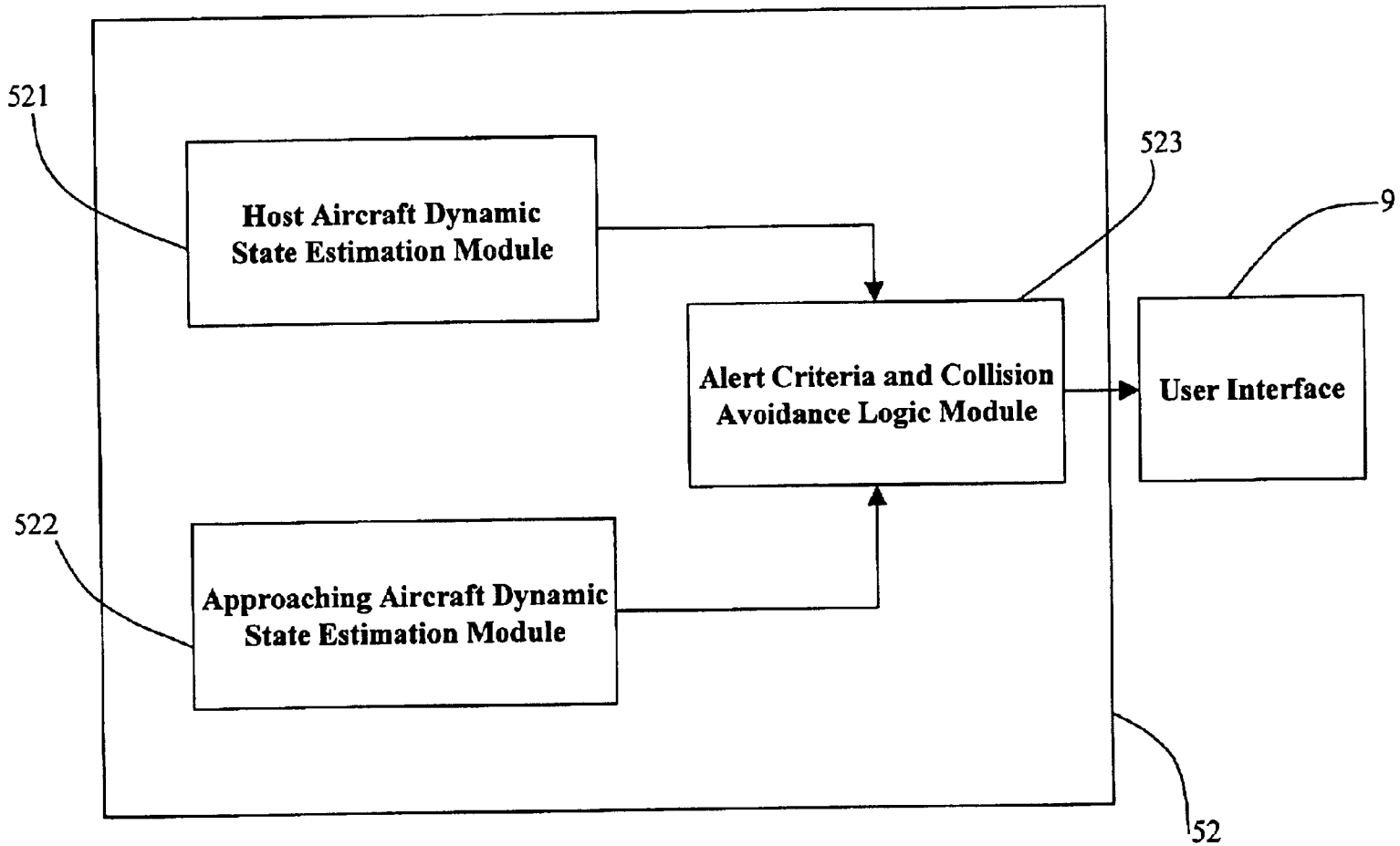
FIG. 4 is a block diagram illustrating the collision avoidance mechanism of the collision avoidance detection and warning module according to the above preferred embodiment of the present invention.

The collision detection and warning module 52 implements the collision avoidance mechanism and aircraft trajectory prediction algorithm. The collision detection and warning module 52 is a software package consisting of algorithms and decision making routines. This software module runs on the central processing unit 5 of the collision detection and warning system. This module, which coordinates other functional modules, is the core part of the entire system. Its structure is shown in FIG. 4.

With the data link communication by the date link receiver/transmitter 7 between the host aircraft and the other participating aircraft and with the aid of the user interface and display unit 9, the major concern of the collision avoidance system is to maintain a safe distance between the host aircraft and the participating aircraft.

Collision of aircraft within the group is avoided by beginning with two aircrafts, a host aircraft and another participating aircraft. The host aircraft assumes the entire responsibility for evading the other participating aircraft. Typically, a minimum distance of 5000 feet is maintained between the primary and participating aircrafts. However, a collision avoidance scheme must take into account the possibility for unexpected near proximity situations. The participating aircraft may not respond to the presence of the host aircraft, except in an extremely precarious situation.

The data link management module 54 realizes and manages the communication logic for the entire system.

The user Interface and display unit 9 offers visual and aural data presentation, facilities to pilots of the primary and participating aircraft and receives instruction from the pilots.

Referring to FIG. 4, the collision detection and warning module 52 further comprises:

(5.2.1) a host aircraft dynamic state estimation module 521 producing a real-time dynamic state of the host aircraft by using position data from the GPS/IMU relative positioning module 51, wherein GPS data and INS data are fully coupled and integrated;

(5.2.2) an approaching aircraft dynamic state estimation module 522 predicting a trajectory of the approaching participating aircraft by using the position data from the data link receiver/transmitter 7;

(5.2.3) an alert criteria and collision avoidance logic module 523 producing different levels of warning information for the collision avoidance by using collision avoidance criteria based on prediction of the intersection formed between the host aircraft related region and the participating aircraft (such as an approaching intruder aircraft) related region.

The alert criteria and collision avoidance logic module 523 is the core module of the system. The incoming data from the data link management module 54 and the approaching aircraft dynamic state estimation module 522 are processed. The system alarm level is finally produced based on the result of data processing.

The data link management module 54 further performs the followings:

(5.4.1) A New Vehicle Registration.

Every aircraft approaching the specific airspace needs to be registered into the communication network to become a participating aircraft. The approaching vehicle is first registered in the data link management module 54, its related information is sent to the alert criteria and collision avoidance logic module 523 for future decision making and, lastly, the approaching aircraft is shown on the user interface and display unit 9.

(5.4.2) Un-registration of a Leaving Vehicle.

When one of the participating aircrafts leaves the airspace, it needs to be unregistered from the communication network to release the communication resources. The unregistration information is generated from the data link management module 54, which is sent to the alert criteria and collision avoidance logic module 523 and removed from the user interface and display unit 9.

(5.4.3) Host Dynamic State Broadcasting.

In this collision avoidance system, every aircraft must broadcast its dynamic information to the network. The host aircraft dynamic state estimation module 521 initiates the operation and sends the host aircraft's status to the data link management module 54 at a specified rate.

The host aircraft dynamic state estimation module 52 timely initiates a Collision Avoidance Decision Making cycle. It stimulates the alert criteria and collision avoidance logic module 523 to acquire the dynamic information of the other participating aircrafts. The alert criteria and collision avoidance logic module 523 integrates the information and the decision making and finally sends the decision to the user interface and display module 9 for presentation.

The preliminary architecture calls for all of the host and participating aircraft to share the same nominal frequency band using a Time Division Multiple Access (TDMA). Each of the host and participating aircrafts is assigned a time slot based upon a unique ID. The link would operate asynchronously using frequency shift keying (FSK). This modulation format is robust and does not require a coherent carrier lock for demodulation. The Doppler shift and nominal time delay due to propagation change each time a new aircraft transmits in its time slot. If coherent demodulation is used, phase lock loops would need to reacquire the carrier every time the time slot changes. Doppler shift due to differences in velocity may be on the order of 10 khz. The system is simplified by using incoherent demodulation which is robust to variations in Doppler and does not require rapid carrier acquisition. Master timing of the data link slots would be accomplished using GPS. This calls for linking the GPS receiver and the data link receiver in hardware to transfer time.

Figure 5:
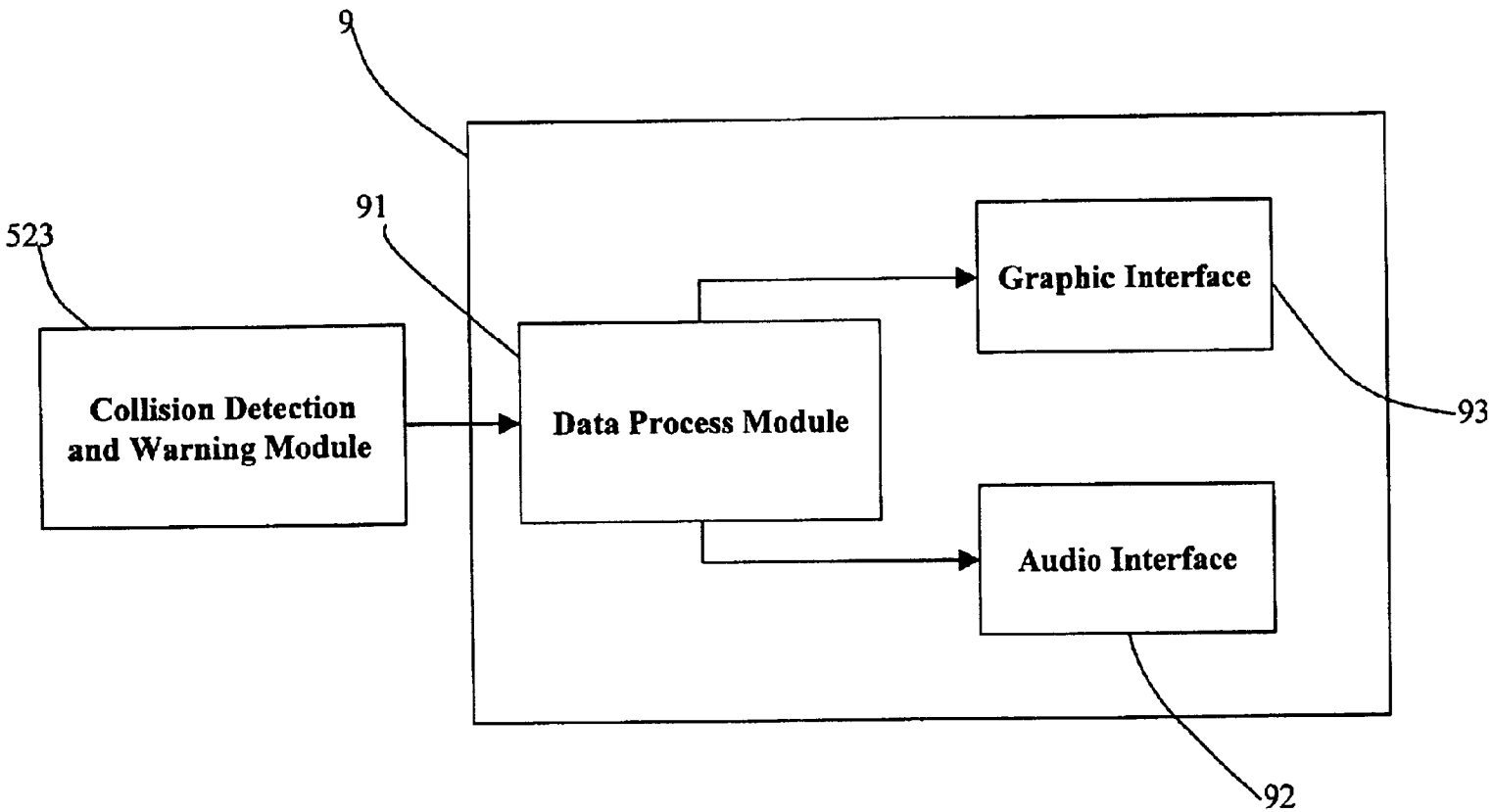
FIG. 5 is a block diagram illustrating the process of the user interface and display module according to the above preferred embodiment of the present invention.

Referring to FIGS. 3 to 5, the user interface and display unit 9 contains an intelligent module designed to graphically display (with audio amended) the relative location, range, azimuth and heading. For convenience, the scale of the display is dynamically changeable. The scale information for the current display is shown on the screen. Other text information about the absolute location of either the host or the participating aircraft is also provided. The user interface and display unit 9 offers a user friendly graphic and audio interface, which represents the system's conclusion and the real time collision avoidance related information. The design is based on the aware-and-watch rule, which minimizes the pilot's intervention. The user interface and display unit only alerts the pilot under certain conditions and can automatically focus on the most critical approaching participating aircraft without any manual operation. The display is intended to have an appearance similar to other current on-board instruments.

Figure 8:
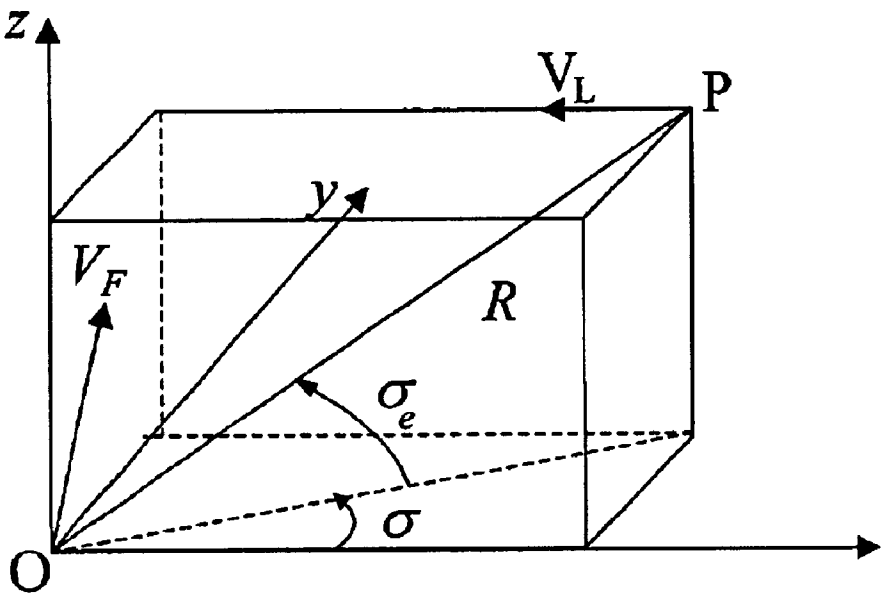
FIG. 8 is a diagram illustrating the geometry between the host and approaching aircraft according to the above preferred embodiment of the present invention.

In the collision avoidance context, monitoring the relative motion among the host and participating aircrafts in the immediate airspace is the most critical issue. As shown in FIG. 8, assume that the host aircraft O is responsible for performing a maneuver to avoid collision with the participating aircraft P. Therefore, relative position, and relative velocity are defined with respect to the host aircraft O. Assume that the host aircraft O is free to maneuver in three-dimensions.

Horizontal maneuvers are more effective in providing long-term separation between the host aircraft O and the participating aircraft P. Vertical maneuvers provide greater immediate separation between the host aircraft O and the participating aircraft P. Less vertical than horizontal separation is typically required between the host aircraft O and the participating aircraft P to avoid the unsafe and collision spaces of either the host aircraft O or the participating aircraft P. A horizontal banking maneuver on the part of the responsible aircraft is more desirable in the event of a slight or medium range evasive maneuver. A vertical maneuver is more advantageous in the event of a violation of the collision space of either the host aircraft O or the participating aircraft P.

The inputs to the collision detection and warning module 52 are the relative position, R, and the relative velocity, V, between these host and participating aircrafts in the navigational frame.

$$R = \begin{bmatrix} \Delta x \\ \Delta y \\ \Delta z \end{bmatrix} = \begin{bmatrix} x_P - x_O \\ y_P - y_O \\ z_P - z_O \end{bmatrix}, \quad V = \begin{bmatrix} \Delta V_x \\ \Delta V_y \\ \Delta V_z \end{bmatrix} = \begin{bmatrix} v_{xP} - v_{xO} \\ v_{yP} - v_{yO} \\ v_{zP} - v_{zO} \end{bmatrix}$$

The true separation range between these host and participating aircrafts is:

$$R_{los} = \sqrt{\Delta x^2 + \Delta y^2 + \Delta z^2}$$

and the range rate is:

$$\dot{R}_{los} = \frac{\Delta x \Delta V_x + \Delta y \Delta V_y + \Delta z \Delta V_z}{R_{los}}$$

These lead to the time-to-go:

$$t_{go} = -\frac{R_{los}}{\dot{R}_{los}}$$

The time-to-go provides an approximate clue on how soon these host and participating aircrafts will collide with each other if they keep approaching. The collision warning data is then sent to the user interface and display unit 9. A rule of thumb is that if $t_{go}$<10.0 seconds, the situation is deemed to be very critical and an immediate action must be taken to avoid a collision.

As shown in FIG. 4, the collision detection and warning module 52 introduces decision making logic to the collision avoidance mechanism. The collision avoidance criteria is based on the prediction of the intersection formed between the host aircraft related region and approaching participating aircraft related region.

The host aircraft related region is defined as the airspace that the host will reach at the next epoch with its current dynamic states. The approaching particapting aircraft related region is classified into 2 sub-region classes. The sub-region class one is defined as the host aircraft related region and the region the approaching participating aircraft will reach at the next epoch. The sub-region class two is defined as the airspace that the approaching particpating aircraft might reach with its maximum maneuver capability.

The intersections of the host aircraft related region and the two classes of approaching particpating aircraft related regions define different warning levels for the collision avoidance.

Three modules are designed to carry out the previous logic, i.e. the host aircraft dynamic state estimation module 521, the approaching aircraft state estimation module 522, and the alert criteria and collision avoidance logic module 523.

The user interface and display unit 9 is a user friendly intelligent interface, which represents the system's conclusion and the real time collision avoidance related information. The design is based on the aware-and-watch rule, which minimizes the pilot's intervention. The user interface and display unit 9 only alerts the pilot under certain conditions, and can automatically focus on the most critical approaching aircraft without any manual operation. The user interface and display unit 9 is intended to have an appearance similar to other current on-board instruments.

Figure 7:
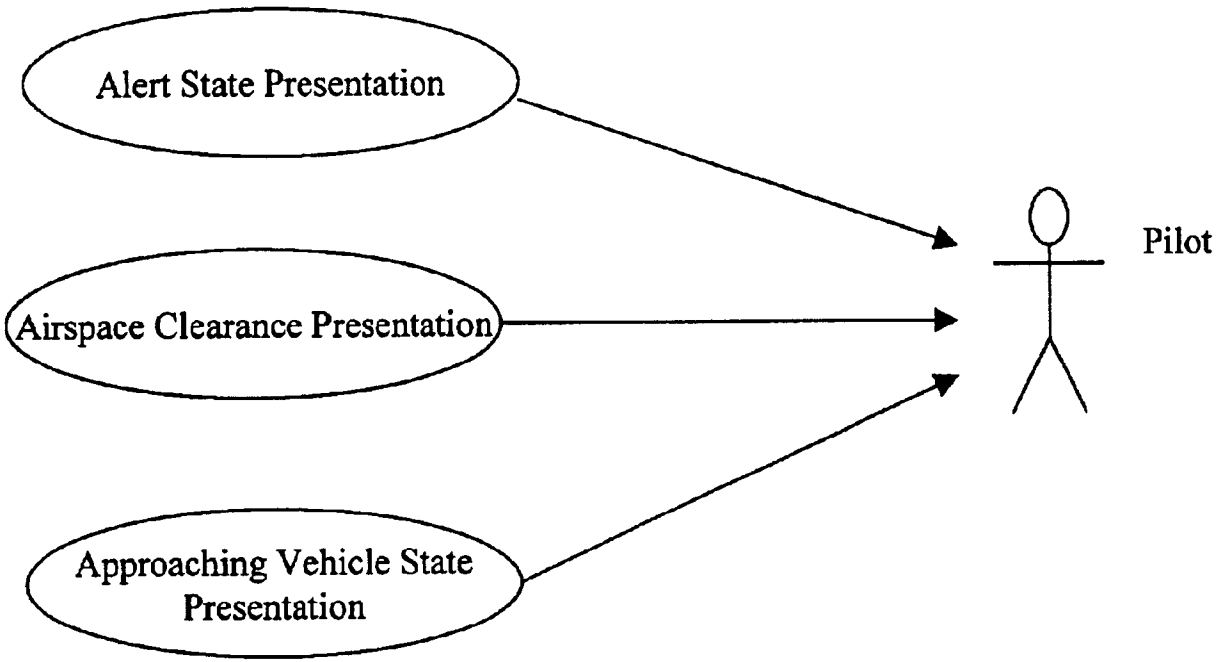
FIG. 7 is a schematic view illustrating the user interface for presenting collision alerts to the pilot according to the above preferred embodiment of the present invention.

The basic requirements of the user interface and display unit 9 are shown in FIG. 7. Three main functions must be provided.

(1) An Alert State Presentation presents the warning level for the collision avoidance states. There are three levels defined for this project: Green level means no collision threat; yellow level represents a potential collision threat; and the red level alerts a collision danger if the host continues its current dynamic state.

(2) An Airspace Clearance Presentation shows the relationship with the surrounding participating aircrafts in graphic and lexical mode. The presentation parameters include relative velocities, relative ranges, and relative directions.

(3) An Approaching Vehicle State Presentation focuses on the behavior of approaching participating aircrafts.

Referring to FIG. 5 and FIG. 3, the user interface and display unit 9 further comprises a data process module 91, an audio interface 92 and a graphite interface 93. There are three sub-modules. The data Process sub-module prepares the information into a suitable format, in which the information can be graphically and acoustically presented. The Graphic Interface and Audio Interface do their specific parts of work to present the information.

The data process module 91 transforms the different warning level information for the collision avoidance from the collision detection and warning module 52 through the collision avoidance information output interface 53 into a data stream in a graphic data format for the graphic interface 93, and into the data stream in an audio data format for the audio interface 92. The graphic interface 93 presents graphic display of the different warning level information for the collision avoidance to the pilot. The audio interface 93 presents voices of the different warning level information for the collision avoidance to the pilot.

Figure 9:
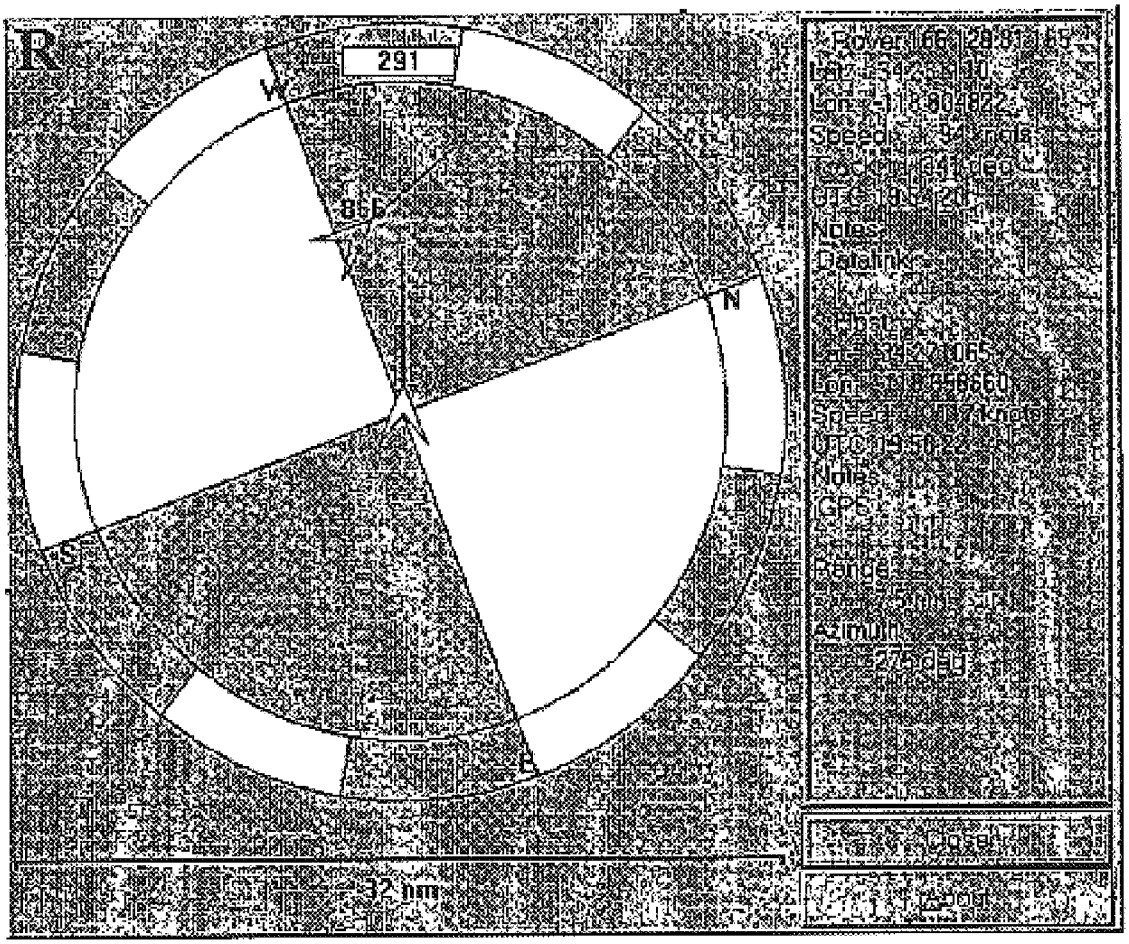
FIG. 9 is a schematic view illustrating an elementary design of the graphic user interface according to the above preferred embodiment of the present invention.

The user interface and display unit 9 is designed to graphically display the relative location, altitude, range, azimuth and heading. For convenience, the scale of the display is dynamically changeable. FIG. 9 shows a design of the user interface and display unit.

The user interface and display unit 9 provides the pilot with a depiction of trajectories related to surrounding aircraft thus effectively yielding a situation awareness display that allows clear identification of the neighborhood flight trajectory tracks and isolation of potential collision paths. The display identifies the bearing and range of all the surrounding participating aircraft and marks the corresponding relative altitude. The neighboring (up to a distance of 40 miles) tracks are colored green. However, the most important, from a collision avoidance viewpoint, tracks are color coded red and the most critical one will blink. For the most threatening conflict, requiring immediate pilot action, the critical blinking path is also accompanied by an audio warning signal.

Auditory warnings add an increased level of safety to the collision avoidance system. Spatial information is derived from the "heads-down" display on the instrument panel. The pilot's visual gaze must first be directed down towards the display and then upwards to search for the traffic target. A directed auditory alert assists the pilot with target acquisition by immediately directing the gaze in the proper direction. Virtual acoustics (3-D audio) techniques may also be applied to increase the pilot's perceived direction of the intruding traffic. Including auditory warnings increases the pilot's visual out-the-window time, thereby further increasing the flight safety.

Figure 6:
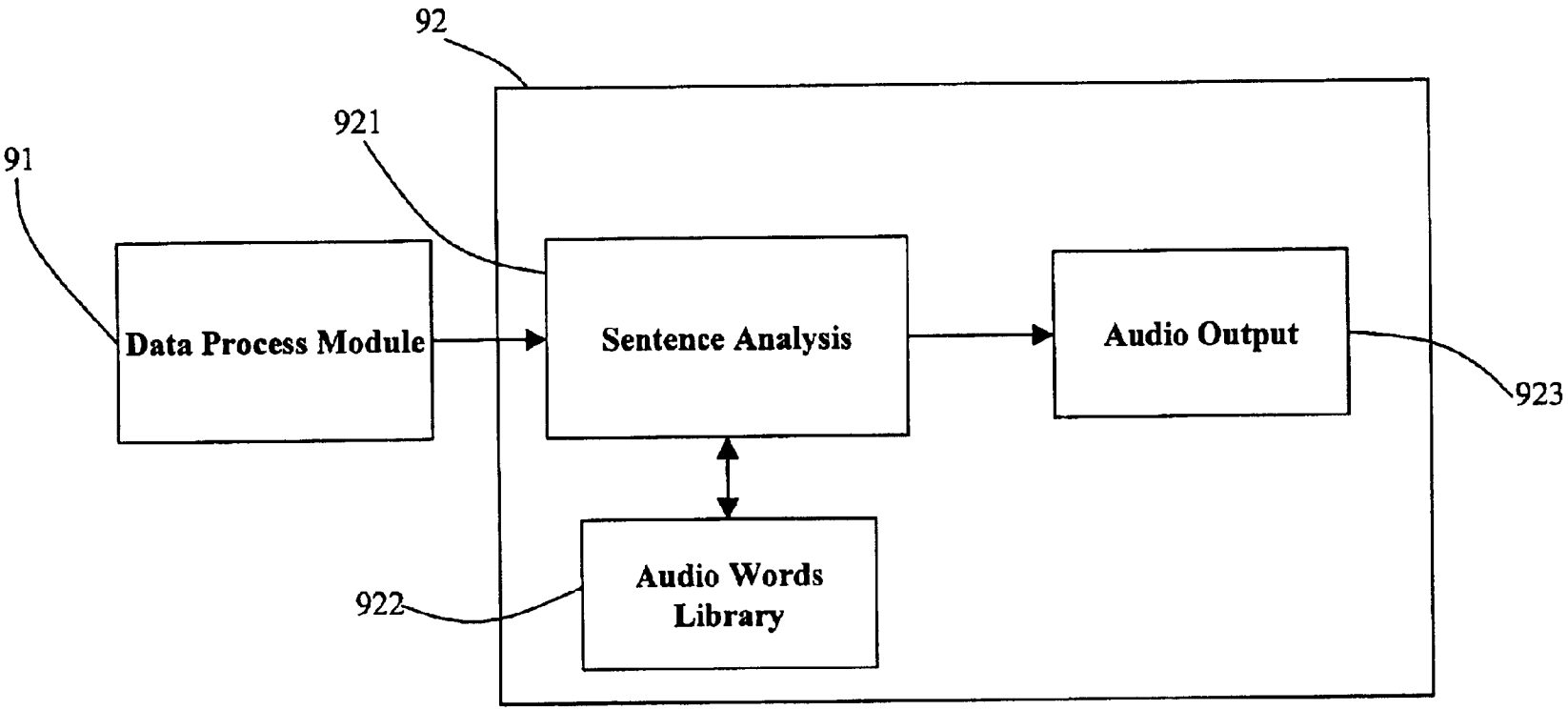
FIG. 6 is a block diagram illustrating the voice warning process of the audio interface according to the above preferred embodiment of the present invention.

Referring to FIG. 6, the audio interface 92 further comprises a sentence analysis module 921, an audio word library 922 and an audio output device 923. The audio word library 922 stores the pre-loaded words and the audio output device 923 generates voice warnings for the pilot. The sentence analysis module 921 generates sentences using a data stream in audio data format and relevent words from the audio word library 922 to the audio output device 923.

FIG. 6 shows the structure for the audio warning subsystem, which comprises the data processing module 91, the sentence analysis module 921, the audio word library 922, and the audio output module 923. The audio warning message is sent to the sentence analysis module 921, where appropriate sentences are generated for the presentation of the given information. Relevant words are derived from the audio word library 922, and then delivered to the audio output device 923.

The standard terminology for aviation systems will be employed, such as "traffic one o'clock", "traffic ten o'clock, 2 miles", etc.

Figure 10:
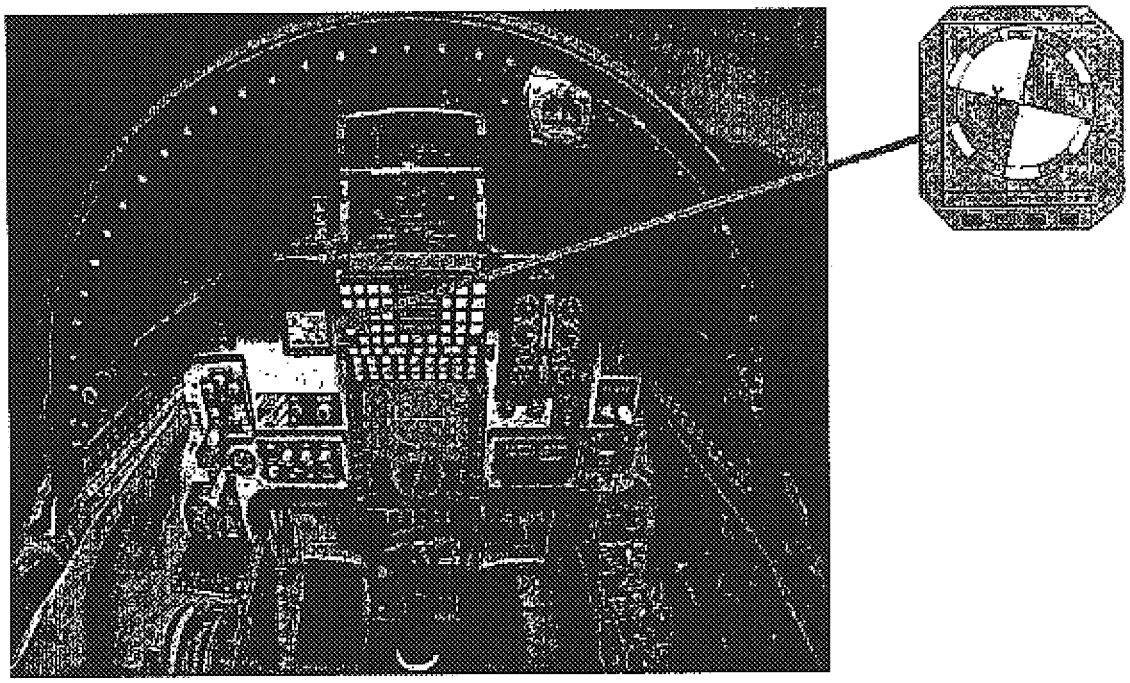
FIG. 10 is a schematic view illustrating a collision avoidance system installed in a T-38C cockpit according to the above preferred embodiment of the present invention.

The system is packaged for mounting in a standard 3 inch instrument panel location or as a carried on item. The packaging concept would be compatible with mounting in an aircraft cockpit such as the T-38C, shown in FIG. 10.

What is claimed is:

1. A collision avoidance system, carried in a host aircraft, comprising:

an IMU (Inertial Measurement Unit) providing inertial motion measurements;

a GPS (Global Positioning System) receiver providing GPS positioning measurements;

a data link receiver/transmitter exchanging position data between the host aircraft and at least a participating aircraft;

a central processing unit receiving said inertial motion measurements from said IMU, said GPS positioning measurements from said GPS receiver, and aircraft position information from said data link receiver/transmitter to produce a plurality of warning level information for a collision avoidance; and an interface and display unit presenting warning level information for collision avoidance states to a pilot of said host aircraft.

2. The collision avoidance system, as recited in claim 1, wherein said central processing unit further comprises:

a GPS/IMU relative positioning module producing an uninterrupted position information;

a collision detection and warning module receiving said uninterrupted position information from said GPS/IMU relative positioning module and other aircraft position information from said data link receiver/transmitter through said GPS/IMU relative positioning module to produce said warning level information for said collision avoidance;

a collision avoidance information output interface providing an interface with said interface and display unit and feeding said warning level information for said collision avoidance to said interface and display unit; and a data link management module realizing and managing a communication logic for said collision avoidance system.

3. A method for intelligent collision detection and warning for a host aircraft, comprising the steps of:

(a) providing inertial motion measurements by an IMU (Inertial Measurement Unit);

(b) providing GPS positioning measurements by a GPS (Global Positioning System) receiver;

(c) exchanging position data between the host aircraft and at least a participating aircraft by a data link receiver/transmitter;

(d) sending said inetial motion measurements from said IMU, said GPS positioning measurements from said GPS receiver, and aircraft position information from said data link receiver/transmitter to a central processing unit to produce a plurality of warning level information for a collision avoidance; and (e) presenting a warning level information by an interface and display unit to a pilot of said host aircraft.

4. The method, as recited in claim 3, wherein the step (d) further comprises the steps of:

(d.1) producing an uninterrupted position information by a GPS/IMU relative positioning module;

(d.2) sending said uninterrupted position information from said GPS/IMU relative positioning module and other aircraft position information from said data link receiver/transmitter through said GPS/IMU relative positioning module to a collision detection and warning module to produce said warning level information for said collision avoidance;

(d.3) providing a collision avoidance information output interface with said interlace and display unit and feeding said warning level information for said collision avoidance to said interface and display unit; and (d.4) realizing and managing a communication logic for said collision avoidance system by a data link management module.

5. A collision avoidance system, carried in a host aircraft, comprising:

an IMU (Inertial Measurement Unit) providing inertial motion measurements;

a GPS (Global Positioning System) receiver providing GPS positioning measurements;

a data link receiver/transmitter exchanging position data between the host aircraft and a participating aircraft;

a central processing unit receiving said inertial motion measurements from said IMU, said GPS positioning measurements from said GPS receiver, and aircraft position information from said data link receiver/transmitter to produce a plurality of warning level information for a collision avoidance, wherein said central processing unit further comprises:

a GPS/IMU relative positioning module producing an uninterrupted position information;

a collision detection and warning module receiving said uninterrupted position information from said GPS/IMU relative positioning module and other aircraft position information from said data link receiver/transmitter through said GPS/IMU relative positioning module to produce said warning level information for said collision avoidance, wherein said collision detection and warning module comprises:

a host aircraft dynamic state estimation module producing a real-time dynamic state of said host aircraft by using position data from said GPS/IMU relative positioning module, wherein GPS data and INS (Inertial Navigation System) data are fully coupled and integrated;

an approaching aircraft dynamic state estimation module predicting a trajectory of said participating aircraft by using said position data from said data link receiver/transmitter; and an alert criteria and collision avoidance logic module producing said warning level information for said collision avoidance by using collision avoidance criteria based on a prediction of an intersection formed between a host aircraft related region and a participating aircraft related region;

a collision avoidance information output interface providing an interface with an interface and display unit and feeding said warning level information for said collision avoidance to said interface and display unit; and a data link management module realizing and managing a communication logic for said collision avoidance system; and said interface and display unit presenting warning level information for collision avoidance states to a pilot of said host aircraft.

6. The collision avoidance system, as recited in claim 5, wherein said data link management module enables each of said host and participating aircrafts approaching an airspace to be registered into a communication network by registering in said data link management module, sending a related information thereof to said alert criteria and collision avoidance logic module for future decision making, and showing said participating aircraft on said interface and display unit.

7. The collision avoidance system, as recited in claim 6, wherein each of said host and participating aircrafts leaving said airspace needs to be unregistered from said communication network to release communication resources, wherein unregistration information generated from said data link management module is sent to said alert criteria and collision avoidance logic module and removed from said interface and display unit.

8. The collision avoidance system, as recited in claim 7, wherein said data link management module enables each of said host and participating aircraft broadcasts dynamic information to said communication network, wherein said host aircraft dynamic state estimation module initiates an operation and sends a status of said host aircraft to said data link management module.

9. The collision avoidance system, as recited in claim 8, wherein said host aircraft dynamic state estimation module timely initiates a collision avoidance decision making cycle that stimulates said alert criteria and collision avoidance logic module to acquire a dynamic information of said participating aircraft.

10. The collision avoidance system, as recited in claim 9, wherein said alert criteria and collision avoidance logic module integrates said dynamic information and makes a decision which is sent to said user interface and display module for presentation.

11. The collision avodiance system, as recited in claim 10, wherein said interface and display unit further comprises a data process module, an audio interface and a graphite interface, wherein said data process module transforms a plurality of warning level information for collision avoidance states from said collision detection and warning module through said collision avoidance information output interface into a data stream in a graphic data format for said graphic interface, and into said data stream in an audio data format for said audio interface, wherein said graphic interface presents graphic display of said warning level information to said pilot and said audio interface presents voices of said warning level information for said collision avoidance states to said pilot, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

12. The collision avoidance system, as recited in claim 8, wherein said host aircraft related region is defined as an airspace that said host aircraft is going to reach at a next epoch with current dynamic states thereof, wherein said participating aircraft related region is classified into a first and a second sub-region class, wherein said first sub-region class one is defined as said host aircraft related region and a region said participating aircraft is going to reach at said next epoch and said second sub-region class is defined as said airspace that said participating aircraft is capable of reaching with a maximum maneuver capability thereof.

13. The collision avoidance system, as recited in claim 5, wherein said host aircraft dynamic state estimation module timely initiates a collision avoidance decision making cycle that stimulates said alert criteria and collision avoidance logic module to acquire a dynamic information of said participating aircraft.

14. The collision avoidance system, as recited in claim 13, wherein said alert criteria and collision avoidance logic module integrates said dynamic information and makes a decision which is sent to said user interface and display module for presentation.

15. The collision avoidance system, as recited in claim 14, wherein said host aircraft related region is defined as an airspace that said host aircraft is going to reach at a next epoch with current dynamic states thereof, wherein said participating aircraft related region is classified into a first and a second sub-region class, wherein said first sub-region class one is defined as said host aircraft related region and a region said participating aircraft is going to reach at said next epoch and said second sub-region class is defined as said airspace that said participating aircraft is capable of reaching with a maximum maneuver capability thereof.

16. The collision avoidance system, as recited in claim 15, wherein said warning level information for collision avoidance states of said interface and display unit includes a first level that means no collision threat, a second level that represents a potential collision threat, and a third level that alerts a collision danger if said host aircraft continues a current dynamic state thereof; shows a relationship with said participating aircraft in a graphic and lexical mode, wherein presentation parameters include relative velocities, relative ranges, and relative directions; and focuses on a behavior of said participating aircraft.

17. The collision avodiance system, as recited in claim 14, wherein said interface and display unit further comprises a data process module, an audio interface and a graphite interface, wherein said data process module transforms a plurality of warning level information for collision avoidance states from said collision detection and warning module through said collision avoidance information output interface into a data stream in a graphic data format for said graphic interface, and into said data stream in an audio data format for said audio interface, wherein said graphic interface presents graphic display of said warning level information to said pilot and said audio interface presents voices of said warning level information for said collision avoidance states to said pilot.

18. The collision avoidance system, as recited in claim 17, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

19. The collision avoidance system, as recited in claim 5, wherein said host aircraft related region is defined as an airspace that said host aircraft is going to reach at a next epoch with current dynamic states thereof, wherein said participating aircraft related region is classified into a first and a second sub-region class, wherein said first sub-region class one is defined as said host aircraft related region and a region said participating aircraft is going to reach at said next epoch and said second sub-region class is defined as said airspace that said participating aircraft is capable of reaching with a maximum maneuver capability thereof.

20. The collision avodiance system, as recited in claim 5, wherein said interface and display unit further comprises a data process module, an audio interface and a graphite interface, wherein said data process module transforms a plurality of warning level information for collision avoidance states from said collision detection and warning module through said collision avoidance information output interface into a data stream in a graphic data format for said graphic interface, and into said data stream in an audio data format for said audio interface, wherein said graphic interface presents graphic display of said warning level information to said pilot and said audio interface presents voices of said warning level information for said collision avoidance states to said pilot.

21. The collision avoidance system, as recited in claim 20, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

22. A collision avoidance system, carried in a host aircraft, comprising:

an IMU (Inertial Measurement Unit) providing inertial motion measurements;

a GPS (Global Positioning System) receiver providing GPS positioning measurements;

a data link receiver/transmitter exchanging position data between the host aircraft and at least a participating aircraft;

a central processing unit receiving said inertial motion measurements from said IMU, said GPS positioning measurements from said GPS receiver, and aircraft position information from said data link receiver/transmitter to produce a plurality of warning level information for a collision avoidance, wherein said central processing unit comprises:

a GPS/IMU relative positioning module producing an uninterrupted position information;

a collision detection and warning module receiving said uninterrupted position information from said GPS/IMU relative positioning module and other aircraft position information from said data link receiver/transmitter through said GPS/IMU relative positioning module to produce said warning level information for said collision avoidance;

a collision avoidance information output interface providing an interface with an interface and display unit and feeding said warning level information for said collision avoidance to said interface and display unit; and a data link management module realizing and managing a communication logic for said collision avoidance system, wherein said data link management module enables each of said host and participating aircrafts approaching an airspace to be registered into a communication network by registering in said data link management module, and sending a related information thereof to said collision detection and warning module for future decision making; and said interface and display unit presenting warning level information for collision avoidance states to a pilot of said host aircraft and showing said participating aircraft.

23. The collision avoidance system, as recited in claim 22, wherein each of said host and participating aircrafts leaving said airspace needs to be unregistered from said communication network to release communication resources, wherein unregistration information generated, from said data link management module is sent to said alert criteria and collision avoidance logic module and removed from said interface and display unit.

24. The collision avoidance system, as recited in claim 23, wherein said data link management module enables each of said host and participating aircraft broadcasts dynamic information to said communication network.

25. The collision avodiance system, as recited in claim 24, wherein interface and display unit further comprises a data process module, an audio interface and a graphite interface, wherein said data process module transforms a plurality of warning level information for collision avoidance states from said collision detection and warning module through said collision avoidance information output interface into a data stream in a graphic data format for said graphic interface, and into said data stream in an audio data format for said audio interface, wherein said graphic interface presents graphic display of said warning level information to said pilot and said audio interface presents voices of said warning level information for said collision avoidance states to said pilot.

26. The collision avoidance system, as recited in claim 25, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

27. A collision avoidance system, carried in a host aircraft, comprising:

an IMU (Inertial Measurement Unit) providing inertial motion measurements;

a GPS (Global Positioning System) receiver providing GPS positioning measurements;

a data link receiver/transmitter exchanging position data between the host aircraft and at least a participating aircraft;

a central processing unit receiving said inertial motion measurements from said IMU, said GPS positioning measurements from said GPS receiver, and aircraft position information from said data link receiver/transmitter to produce a plurality of warning level information for a collision avoidance; and an interface and display unit presenting warning level information for collision avoidance states to a pilot of said host aircraft, said warning level information for collision avoidance states of said interface and display unit including a first level that means no collision threat, a second level that represents a potential collision threat, and a third level that alerts a collision danger if said host aircraft continues a current dynamic state thereof, showing a relationship with said participating aircraft in a graphic and lexical mode, wherein presentation parameters include relative velocities, relative ranges, and relative directions, and focusing on a behavior of said participating aircraft.

28. The collision avodiance system, as recited in claim 27, wherein interface and display unit further comprises a data process module, an audio interface and a graphite interface, wherein said data process module transforms a plurality of warning level information for collision avoidance states from said collision detection and warning module through said collision avoidance information output interface into a data stream in a graphic data format for said graphic interface, and into said data stream in an audio data format for said audio interface, wherein said graphic interface presents graphic display of said different warning level information for said collision avoidance to said pilot and said audio interface presents voices of said warning level information for said collision avoidance states to said pilot.

29. The collision avoidance system, as recited in claim 28, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

30. A collision avoidance system, carried in a host aircraft, comprising:

an IMU (Inertial Measurement Unit) providing inertial motion measurements;

a GPS (Global Positioning System) receiver providing GPS positioning measurements;

a data link receiver/transmitter exchanging position data between the host aircraft and at least a participating aircraft;

a central processing unit receiving said inertial motion measurements from said IMU, said GPS positioning measurements from said GPS receiver, and aircraft position information from said data link receiver/transmitter to produce a plurality of warning level information for a collision avoidance; and an interface and display unit presenting warning level information for collision avoidance states to a pilot of said host aircraft, wherein said interface and display unit is designed for graphically displaying relative location, altitude, range, azimuth and heading of said participating aircraft and providing said pilot with a depiction of trajectories related to said participating aircraft to effectively yield a situation awareness display that allows a clear identification of neighborhood flight trajectory tracks and isolation of potential collision paths so as to identify said a bearing and range of said participating aircraft and mark a corresponding relative altitude.

31. A collision avoidance system, carried in a host aircraft, comprising:

an IMU (Inertial Measurement Unit) providing inertial motion measurements;

a GPS (Global Positioning System) receiver providing GPS positioning measurements;

a data link receiver/transmitter exchanging position data between the host aircraft and at least a participating aircraft;

a central processing unit receiving said inertial motion measurements from said IMU, said GPS positioning measurements from said GPS receiver, and aircraft position information from said data link receiver/transmitter to produce a plurality of warning level information for a collision avoidance, wherein said central processing unit further comprises:

a GPS/IMU relative positioning module producing an uninterrupted position information;

a collision detection and warning module receiving said uninterrupted position information from said GPS/IMU relative positioning module and other aircraft position information from said data link receiver/transmitter through said GPS/IMU relative positioning module to produce said warning level information for said collision avoidance;

a collision avoidance information output interface providing an interface with an interface and display unit and feeding said warning level information for said collision avoidance to said interface and display unit; and a data link management module realizing and managing a communication logic for said collision avoidance system; and said interface and display unit presenting warning level information for collision avoidance states to a pilot of said host aircraft, wherein interface and display unit further comprises a data process module, an audio interface and a graphite interface, wherein said data process module transforms a plurality of warning level information for collision avoidance states from said collision detection and warning module through said collision avoidance information output interface into a data stream in a graphic data format for said graphic interface, and into said data stream in an audio data format for said audio interface, wherein said graphic interface presents graphic display of said warning level information to said pilot and said audio interface presents voices of said warning level information for said collision avoidance states to said pilot.

32. The collision avoidance system, as recited in claim 31, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

33. A method for intelligent collision detection and warning, comprising the steps of:

(a) providing inertial motion measurements by an IMU (Inertial Measurement Unit);

(b) providing GPS positioning measurements by a GPS (Global Positioning System) receiver;

(c) exchanging position data between the host aircraft and at least a participating aircraft by a data link receiver/transmitter;

(d) sending said inertial motion measurements from said IMU, said GPS positioning measurements from said GPS receiver, and aircraft position information from said data link receiver/transmitter to a central processing unit to produce a plurality of warning level information for a collision avoidance; and (e) presenting a warning level information by an interface and display unit to a pilot of said host aircraft;

wherein the step (d) further comprises the steps of:

(d.1) producing an uninterrupted position information by a GPS/IMU relative positioning module;

(d.2) sending said uninterrupted position information from said GPS/IMU relative positioning module and other aircraft position information from said data link receiver/transmitter through said GPS/IMU relative positioning module to a collision detection and warning module to produce said warning level information for said collision avoidance;

(d.3) providing a collision avoidance information output interface with said interface and display unit and feeding said warning level information for said collision avoidance to said interface and display unit; and (d.4) realizing and managing a communication logic for said collision avoidance system by a data link management module;

wherein the step (d.2) further comprises the steps of:

(d.2.1) producing a real-time dynamic state of said host aircraft by a host aircraft dynamic state estimation module by using position data from said GPS/IMU relative positioning module, wherein GPS data and INS data are fully coupled and integrated;

(d.2.2) predicting a trajectory of said participating aircraft by an approaching aircraft dynamic state estimation module by using said position data from said data link receiver/transmitter; and (d.2.3) producing said warning level information for said collision avoidance by an alert criteria and collision avoidance logic module by using collision avoidance criteria based on a prediction of an intersection formed between a host aircraft related region and a participating aircraft related region.

34. The method, as recited in claim 33, wherein the step (c) further comprises the steps of:

(c.1) enabling each of said host and participating aircrafts approaching an airspace to be registered into a communication network by registering in said data link management module, (c.2) sending a related information thereof to said alert criteria and collision avoidance logic module for future decision making, and (c.3) showing said participating aircraft on said interface and display unit.

35. The method, as recited in claim 34, wherein the step (c) further comprises the steps of:

(c.4) unregistering from said communication network to release communication resources for each of said host and participating aircrafts which leaves said airspace, (c.5) sending unregistration information generated from said data link management module to said alert criteria and collision avoidance logic module, and (c.6) removing said unregistered participating aircraft from said interface and display unit of said host aircraft.

36. The method, as recited in claim 35, wherein the step (c) further comprises a step (c.7) of enabling each of said host and participating aircraft broadcasts dynamic information to said communication network by said data link management module.

37. The method, as recited in claim 36, wherein the step (d.2.1) further comprises a step of timely initiating a collision avoidance decision making cycle, by said host aircraft dynamic state estimation module, that stimulates said alert criteria and collision avoidance logic module to acquire a dynamic information of said participating aircraft.

38. The method, as recited in claim 37, wherein the step (d.2.3) further comprises a step of integrating said dynamic information and making a decision which is sent to said user interface and display module for presentation by means of said alert criteria and collision avoidance logic module.

39. The method, as recited in claim 38, wherein the step (e) further comprises the steps of:

(e.1) transforming, by a data process module, said warning level information for collision avoidance states from said collision detection and warning module through said collision avoidance information output interface into a data stream in a graphic data format for a graphic interface and in an audio data format for an audio interface, (e.2) presenting a graphic display of said warning level information for said collision avoidance to said pilot by said graphic interface, and (e.3) presenting voices of said warning level information for said collision avoidance states to said pilot by said audio interface;

wherein said audio interface comprises a sentence analysis module, an audio word library and an audio output device, wherein said audio word library stores preloaded words and said audio output device generates voice warnings for said pilot, wherein said sentence analysis module generates sentences using a data stream in said audio data format and relevant words from said audio word library to said audio output device.

40. The method, as recited in claim 36, wherein said host aircraft related region is defined as an airspace that said host aircraft is going to reach at a next epoch with current dynamic states thereof, wherein said participating aircraft related region is classified into a first and a second sub-region class, wherein said first sub-region class one is defined as said host aircraft related region and a region said participating aircraft is going to reach at said next epoch and said second sub-region class is defined as said airspace that said participating aircraft is capable of reaching with a maximum maneuver capability thereof.

41. The method, as recited in claim 33, wherein the step (d.2.1) further comprises a step of timely initiating a collision avoidance decision making cycle, by said host aircraft dynamic state estimation module, that stimulates said alert criteria and collision avoidance logic module to acquire a dynamic information of said participating aircraft.

42. The method, as recited in claim 41, wherein the step (d.2.3) further comprises a step of integrating said dynamic information and making a decision which is sent to said user interface and display module for presentation by means of said alert criteria and collision avoidance logic module.

43. The method, as recited in claim 42, wherein said host aircraft related region is defined as an airspace that said host aircraft is going to reach at a next epoch with current dynamic states thereof, wherein said participating aircraft related region is classified into a first and a second sub-region class, wherein said first sub-region class one is defined as said host aircraft related region and a region said participating aircraft is going to reach at said next epoch and said second sub-region class is defined as said airspace that said participating aircraft is capable of reaching with a maximum maneuver capability thereof.

44. The method, as recited in claim 43, wherein said warning level information for collision avoidance states of said interface and display unit includes a first level that means no collision threat, a second level that represents a potential collision threat, and a third level that alerts a collision danger if said host aircraft continues a current dynamic state thereof; shows a relationship with said participating aircraft in a graphic and lexical mode, wherein presentation parameters include relative velocities, relative ranges, and relative directions; and focuses on a behavior of said participating aircraft.

45. The method, as recited in claim 42, wherein the step (e) further comprises the steps of:

(e.1) transforming, by a data process module, said warning level information for collision avoidance states from said collision detection and warning module through said collision avoidance information output interface into a data stream in a graphic data format for a graphic interface and in an audio data format for an audio interface, (e.2) presenting a graphic display of said warning level information for said collision avoidance to said pilot by said graphic interface, and (e.3) presenting voices of said warning level information for said collision avoidance states to said pilot by said audio interface.

46. The method, as recited in claim 45, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

47. The method, as recited in claim 33, wherein said host aircraft related region is defined as an airspace that said host aircraft is going to reach at a next epoch with current dynamic states thereof, wherein said participating aircraft related region is classified into a first and a second sub-region class, wherein said first sub-region class one is defined as said host aircraft related region and a region said participating aircraft is going to reach at said next epoch and said second sub-region class is defined as said airspace that said participating aircraft is capable of reaching with a maximum maneuver capability thereof.

48. The method, as recited in claim 33, wherein the step (e) further comprises the steps of:

(e.1) transforming, by a data process module, said warning level information for collision avoidance states from said collision detection and warning module through said collision avoidance information output interface into a data stream in a graphic data format for a graphic interface and in an audio data format for an audio interface, (e.2) presenting a graphic display of said warning level information for said collision avoidance to said pilot by said graphic interface, and (e.3) presenting voices of said warning level information for said collision avoidance states to said pilot by said audio interface.

49. The method, as recited in claim 48, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

50. A method for intelligent collision detection and warning, comprising the steps of:

(a) providing inertial motion measurements by an IMU (Inertial Measurement Unit);

(b) providing GPS positioning measurements by a GPS (Global Positioning System) receiver;

(c) exchanging position data between the host aircraft and at least a participating aircraft by a data link receiver/transmitter;

(d) sending said inertial motion measurements from said IMU, said GPS positioning measurements from said GPS receiver, and aircraft position information from said data link receiver/transmitter to a central processing unit to produce a plurality of warning level information for a collision avoidance; and (e) presenting a warning level information by an interface and display unit to a pilot of said host aircraft;

wherein the step (d) further comprises the steps of:

(d.1) producing an uninterrupted position information by a GPS/IMU relative positioning module;

(d.2) sending said uninterrupted position information from said GPS/IMU relative positioning module and other aircraft position information from said data link receiver/transmitter through said GPS/IMU relative positioning module to a collision detection and warning module to produce said warning level information for said collision avoidance;

(d.3) providing a collision avoidance information output interface with said interface and display unit and feeding said warning level information for said collision avoidance to said interface and display unit; and (d.4) realizing and managing a communication logic for said collision avoidance system by a data link management module;

wherein the step (c) further comprises the steps of:

(c.1) enabling each of said host and participating aircrafts approaching an airspace to be registered into a communication network by registering in said data link management module, (c.2) sending a related information thereof to said alert criteria and collision avoidance logic module for future decision making, and (c.3) showing said participating aircraft on said interface and display unit.

51. The method, as recited in claim 50, wherein the step (c) further comprises the steps of:

(c.4) unregistering from said communication network to release communication resources for each of said host and participating aircrafts which leaves said airspace, (c.5) sending unregistration information generated from said data link management module to said alert criteria and collision avoidance logic module, and (c.6) removing said unregistered participating aircraft from said interface and display unit of said host aircraft.

52. The method, as recited in claim 51, wherein the step (c) further comprises a step (c.7) of enabling each of said host and participating aircraft broadcasts dynamic information to said communication network by said data link management module.

53. The method, as recited in claim 52, wherein the step (e) further comprises the steps of:

(e.1) transforming, by a data process module, said warning level information for collision avoidance states from said collision detection and warning module through said collision avoidance information output interface into a data stream in a graphic data format for a graphic interface and in an audio data format for an audio interface, (e.2) presenting a graphic display of said warning level information for said collision avoidance to said pilot by said graphic interface, and (e.3) presenting voices of said warning level information for said collision avoidance states to said pilot by said audio interface.

54. The method, as recited in claim 53, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

55. A method for intelligent collision detection and warning, comprising the steps of:

(a) providing inertial motion measurements by an IMU (Inertial Measurement Unit);

(b) providing GPS positioning measurements by a GPS (Global Positioning System) receiver;

(c) exchanging position data between the host aircraft and at least a participating aircraft by a data link receiver/transmitter;

(d) sending said inertial motion measurements from said IMU, said GPS positioning measurements from said GPS receiver, and aircraft position information from said data link receiver/transmitter to a central processing unit to produce a plurality of warning level information for a collision avoidance; and (e) presenting a warning level information by an interface and display unit to a pilot of said host aircraft;

wherein said warning level information for collision avoidance states of said interface and display unit includes a first level that means no collision threat, a second level that represents a potential collision threat, and a third level that alerts a collision danger if said host aircraft continues a current dynamic state thereof; shows a relationship with said participating aircraft in a graphic and lexical mode, wherein presentation parameters include relative velocities, relative ranges, and relative directions; and focuses on a behavior of said participating aircraft.

56. The method, as recited in claim 55, wherein the step (e) further comprises the steps of:

(e.1) transforming, by a data process module, said warning level information for collision avoidance states from said collision detection and warning module through said collision avoidance information output interface into a data stream in a graphic data format for a graphic interface and in an audio data format for an audio interface, (e.2) presenting a graphic display of said warning level information for said collision avoidance to said pilot by said graphic interface, and (e.3) presenting voices of said warning level information for said collision avoidance states to said pilot by said audio interface.

57. The method, as recited in claim 56, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

58. A method for intelligent collision detection and warning, comprising the steps of:

(a) providing inertial motion measurements by an IMU (Inertial Measurement Unit);

(b) providing GPS positioning measurements by a GPS (Global Positioning System) receiver;

(c) exchanging position data between the host aircraft and at least a participating aircraft by a data link receiver/transmitter;

(d) sending said inertial motion measurements from said IMU, said GPS positioning measurements from said GPS receiver, and aircraft position information from said data link receiver/transmitter to a central processing unit to produce a plurality of warning level information for a collision avoidance; and (e) presenting a warning level information by an interface and display unit to a pilot of said host aircraft;

wherein said interface and display unit is designed for graphically displaying relative location, altitude, range, azimuth and heading of said participating aircraft and providing said pilot with a depiction of trajectories related to said participating aircraft to effectively yield a situation awareness display that allows a clear identification of neighborhood flight trajectory tracks and isolation of potential collision paths so as to identify said a bearing and range of said participating aircraft and mark a corresponding relative altitude.

59. A method for intelligent collision detection and warning, comprising the steps of:

(a) providing inertial motion measurements by an IMU (Inertial Measurement Unit);

(b) providing GPS positioning measurements by a GPS (Global Positioning System) receiver;

(c) exchanging position data between the host aircraft and at least a participating aircraft by a data link receiver/transmitter;

(d) sending said inertial motion measurements from said IMU, said GPS positioning measurements from said GPS receiver, and aircraft position information from said data link receiver/transmitter to a central processing unit to produce a plurality of warning level information for a collision avoidance; and (e) presenting a warning level information by an interface and display unit to a pilot of said host aircraft;

wherein the step (d) further comprises the steps of:

(d.1) producing an uninterrupted position information by a GPS/IMU relative positioning module;

(d.2) sending said uninterrupted position information from said GPS/IMU relative positioning module and other aircraft position information from said data link receiver/transmitter through said GPS/IMU relative positioning module to a collision detection and warning module to produce said warning level information for said collision avoidance;

(d.3) providing a collision avoidance information output interface with said interface and display unit and feeding said warning level information for said collision avoidance to said interface and display unit; and (d.4) realizing and managing a communication logic for said collision avoidance system by a data link management module;

wherein the step (e) further comprises the steps of:

(e.1) transforming, by a data process module, said warning level information for collision avoidance states from said collision detection and warning module through said collision avoidance information output interface into a data stream in a graphic data format for a graphic interface and in an audio data format for an audio interface, (e.2) presenting a graphic display of said warning level information for said collision avoidance to said pilot by said graphic interface, and (e.3) presenting voices of said warning level information for said collision avoidance states to said pilot by said audio interface.

60. The method, as recited in claim 59, wherein said audio interface comprises a sentence analysis module, an audio word library and an audio output device, wherein said audio word library stores pre-loaded words and said audio output device generates voice warnings for said pilot, wherein said sentence analysis module generates sentences using a data stream in said audio data format and relevant words from said audio word library to said audio output device.

* * * * *